United States Patent [19]

Clay

[11] 4,065,334

[45] Dec. 27, 1977

[54] FUR AND HIDES IN THE FINE ARTS

[76] Inventor: Clifton Clay, 11215 Itasca, Cleveland, Ohio 44106

[21] Appl. No.: 645,434

[22] Filed: Dec. 30, 1975

[51] Int. Cl.[2] ..... C14B 1/02

[52] U.S. Cl. ..... 156/68; 69/22; 428/16

[58] Field of Search ..... 69/22; 156/68, 7; 428/15, 16, 85; 35/20, 26

[56] References Cited

U.S. PATENT DOCUMENTS

| | | | |
|---|---|---|---|
| 1,737,086 | 11/1929 | Horstmann | 69/22 |
| 2,161,830 | 6/1939 | Linet | 69/22 |
| 2,432,360 | 12/1947 | Weisberg | 69/22 |
| 2,455,436 | 12/1948 | Naidor | 69/22 |
| 3,755,057 | 8/1973 | Scott | 156/93 |

FOREIGN PATENT DOCUMENTS

| | | | |
|---|---|---|---|
| 590,002 | 1/1960 | Canada | 156/86 |

*Primary Examiner*—Edward G. Whitby
*Attorney, Agent, or Firm*—Frederic B. Schramm

[57] ABSTRACT

A hide or skin painting is produced by removing the hair in areas of a buffalo hide with a special curved edge cutting tool having changing radius of curvature, leaving areas of the skin with hair intact, applying acrylic pigment to the bare skin from which hair has been removed, and mounting the painted hide in a rectangular wooden frame by thongs.

3 Claims, 10 Drawing Figures

FUR AND HIDES IN THE FINE ARTS

BACKGROUND OF THE INVENTION

For some time before the past year I have been successful in showing and selling a unique type of a work of art which I have originated in which a hide or skin such as cowhide or calfhide is soft tanned and stretched with the hair scraped away in certain areas in order that these areas might be decorated with oil paint to produce an artistic design in which the effect is enhanced by the portions of the hair left on the hide.

I have become familiar with U.S. Pat No. 2,901,373 issued to Ernst Weiss relating to a pattern flock fabric in which there is a nap or pile composed of short textural fibers in which the flock is at least partially dissolved in selected pattern areas in which a base fabric results having no nap or upstanding fabric. My development differs from such ornamental fabric in that it is formed from an originally natural source such as an animal hide, is not a fabric at all, and does not require the application of fibers to the natural skin base nor the use of solvents, adhesives or other chemicals to apply fur or hair to the skin.

Within the past year I have developed improved skin paintings and methods of producing them which eliminates the need for stretching and avoids any shrinking, curling or wrinkling of the skin as well as producing more aesthetic and attractive designs having a hair portion of better feel and a painted portion which may be produced more quickly in that the pigment dries more rapidly, the design may be revised in areas if desired, greater precision in the outlines of portion of the design may be achieved and the finished work is more durable.

BRIEF DESCRIPTION

The invention relates to hide or skin paintings and the art of utilizing natural skins and hides in forming two dimensional works of art in color and partial relief. In carrying out the invention in accordance with a preferred form, hides having either uniformly colored or varied colored fur or hair are utilized. A suitable pattern of the hair is removed to leave parts bare in defined areas upon which a portion of the design may be formed. Although I have used oil paints in the past, within the past year I have improved my technique and use acrylic pigments. The remainder of the design is formed in color and shallow relief by the fur areas, the outlines of which have been determined by the outlines of the area from which hair has been removed. Although I have employed soft tanned skins such as cowhide, calfhide or even bearhide, within the past year I have improved my product with a much finer feel by employing buffalo hide. I also consider elk hide and moosehide advantageous. Instead of merely scraping away some of the hair in desired areas by a scraper such as a razor blade with the edge ground to a suitable shape, I now use a cutting tool having a curved edge with a continuously varying radius of curvature in order that the outlines along which the hair is removed from the skin may be provided very precisely with the desired shape.

For display the finished skin painting is hung upon a frame by cords formed of leather thongs or other suitable material and the painted hide is reinforced by a backing of masonite or other hard or stiff board or plywood.

DRAWINGS

A better understanding of the invention will be afforded by the following detailed description considered in conjunction with the accompanying drawings in which FIG. 1 represents a tanned buffalo hide to be used in carrying out my invention.

Like reference characters are utilized throughout the drawings to designate like parts.

DETAILED DESCRIPTION OF THE WORK OF ART AND METHOD OF PRODUCING IT

Figure 1:
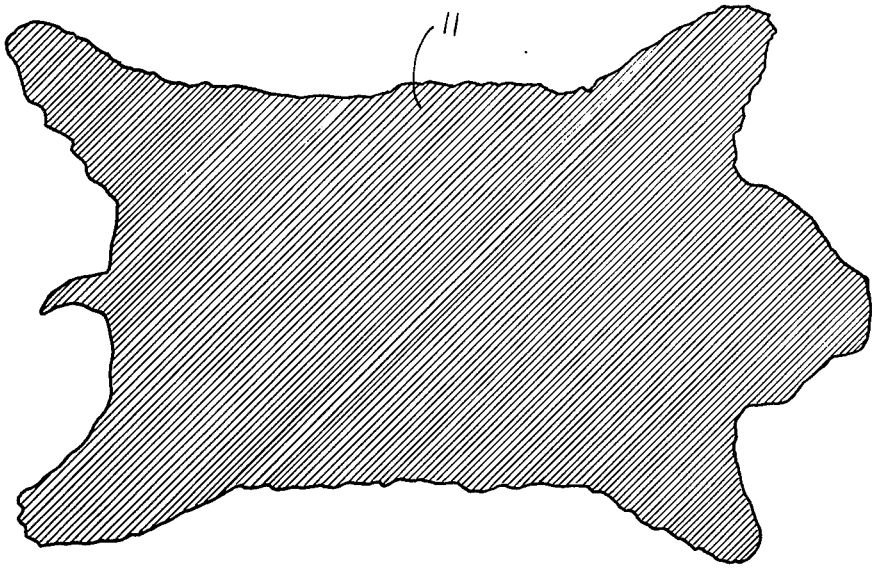
Figure 6:
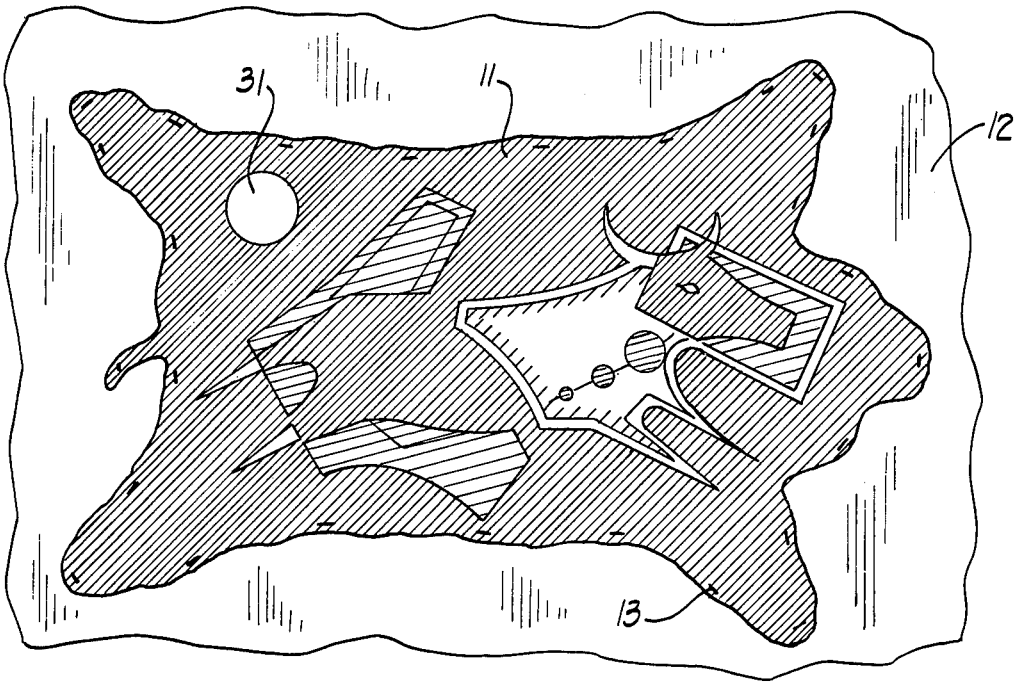
FIG. 6 is a view of the skin tacked to a wall or other vertical surface to enable the design to be cut and the skin to be painted where bared.

As shown in FIGS. 1 and 6 a tanned hide, fine fur or hair with a fine feel, preferably a buffalo hide, is attached to a working surface preferably a vertical surface such as a wall, nailing it to the wall by means of a stapling gun. The hide has the outline resulting from skinning the animal.

Figure 2:
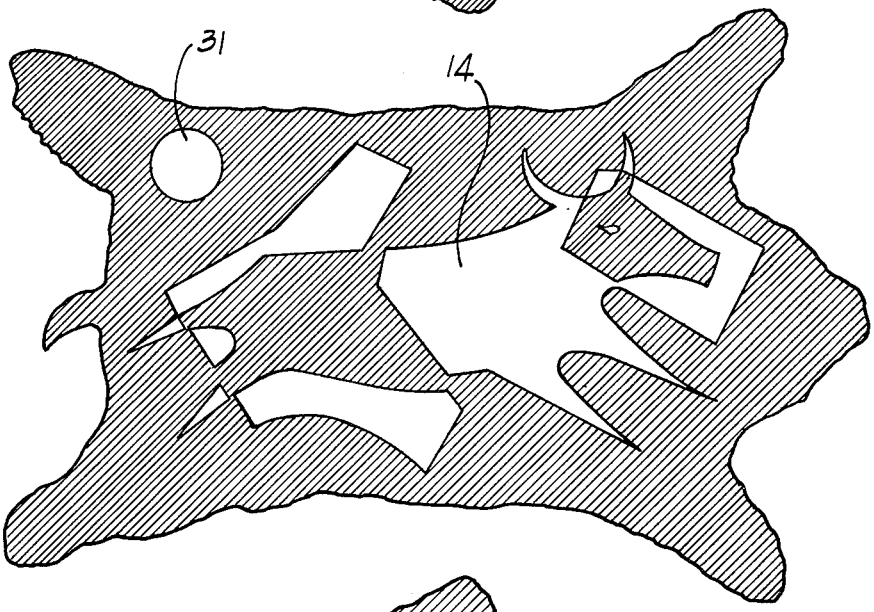
FIG. 2 is a drawing of the hide after certain portions have been cut away to form outlines which in themselves form a part of the finished design.
Figure 7:
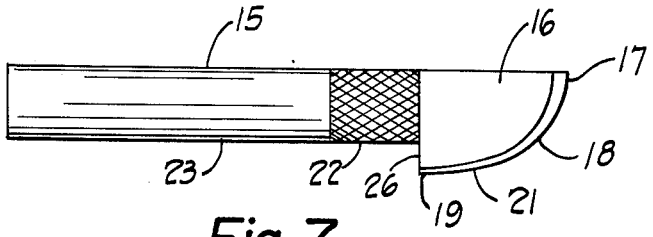
FIG. 7 is a view of a cutting tool having a beveled edge which is curved along a continuously varying radius of curvature.
Figure 10:
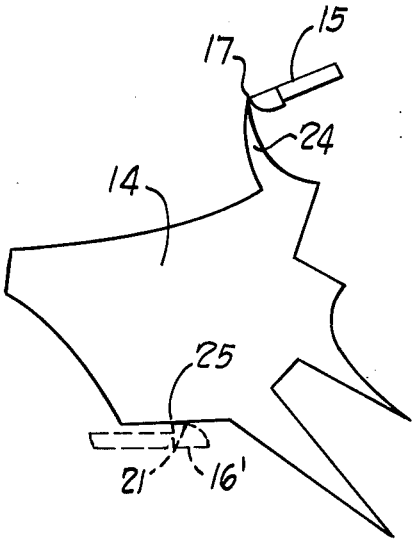
FIG. 10 is a diagram illustrating the manner of using different portions of the curvature of the cutting tool of FIG. 7.

While the skin 11 is nailed to the wall 12 by means of nails or staples 13, portions or areas 14 of the skin as shown in FIGS. 2 and 10 are made bare by cutting with the tool 15 of FIG. 7 which has a curved beveled blade 16 with a sharp point 17 at one end of the edge 18. The edge 18 curves with a continuously increasing radius of curvature to the end 19 of the cutting edge 18. The portion of the edge 18 towards the end 19 has a relatively large radius of curvature so as to present a relatively flat portion 21. The portion 21 is also offset from the adjacent portion 22 of the handle 23 of the tool 15.

The invention is not limited to the use of a specific make of cutting tool but I have obtained satisfactory results by employing a woodcarver's knife of the type manufactured by Exacto Company, Model No. 22. The tool 15 is used as shown in FIG. 10 with the sharp point portion 17 of the blade edge 18 used to cut away hairs in the tip end narrow portions 24 of the outline of the area 14 of the design. On the other hand in the relatively straight but gradually curving portions 25 of the outline of the area 14, the relatively flat edged portion 21 of the blade 16 is employed in order to make a relatively broad cut and facilitate the de-hairing of the skin relatively rapidly. The offset 26 between the portions 19 and 22 as shown in FIG. 7 of the drawing enables the entire portion 21 of the edge 18 adjacent to the end 19 to be employed in the cutting away hair without interference from the handle 23. The gradually changing curvature of the edge 18 also enables rapid cuts to be made in portions of the outline of an area such as the area 14 where the outline has a relatively long-radius, concave curvature.

In case a skin is encountered in which the hairs are unusually fluffy, flexible and weak, making it difficult to cut them even close to the surface of the skin, the hairs may be embrittled in a desired portion of the hide by employing a heated iron having a hot metallic tip 27 in the form of a square bar similar to heated tips of electrical soldering irons, for example. The end of the bar is preferably cut off at an angle along a surface 28 to provide a relatively large hot surface for embrittling hairs and also providing a sharp edge 29 to facilitate reaching sharp corners within the outline of a portion of the hide to be de-haired. When the iron 27 is employed for embrittling some or all of the hairs, the operation is followed by cutting away the hairs by means of a tool such as the tool 15 previously described.

Figure 8:
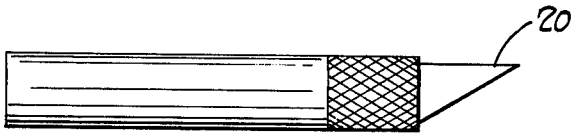
FIG. 8 is a tool of a type which I have heretofore employed.
Figure 9:
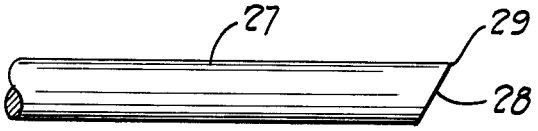
FIG. 9 is a view of the tip of a heating tool which may in some cases be employed if desired to dry the hairs in certain areas to embrittle them and facilitate cutting them.

I have found that the tool with the edge 18 of continuous varying radius enables me to produce superior results and complete a design more quickly than by means of the tool of FIG. 8 having a triangular blade 20 with an acute angle at the point.

Figure 3:
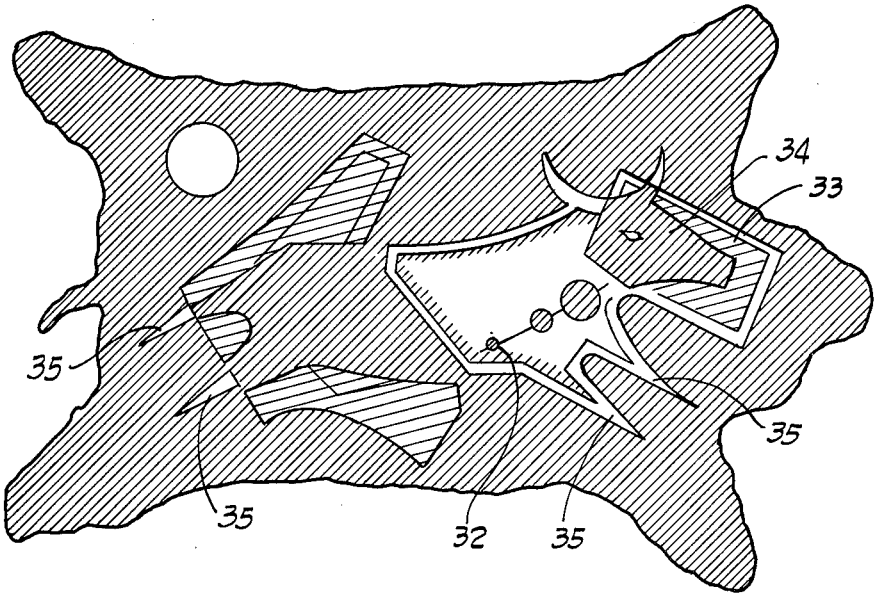
FIG. 3 is a view of the skin after acrylic pigment has been applied thereto, preferably in brilliant splashes of color, merely represented by shading in the patent drawing, with the design elements predominantly in the form of circles, triangles and rectangles to produce a tribal design.
Figure 4:
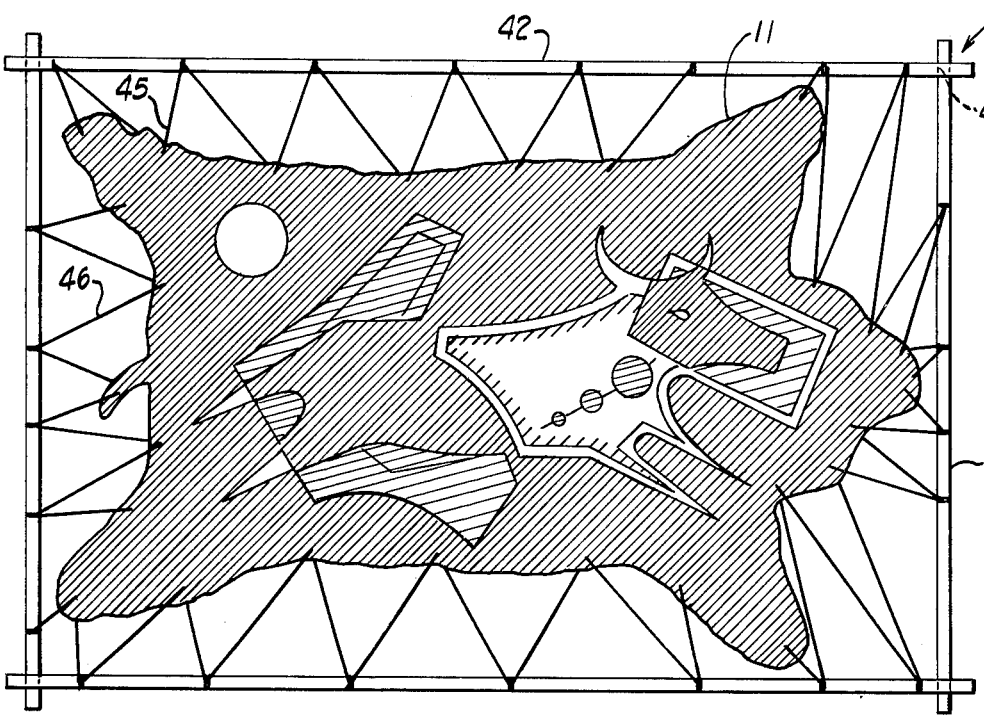
FIG. 4 is a view of the completed work of art mounted in a wooden framework.
Figure 5:
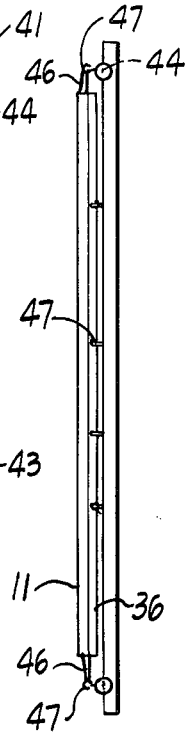
FIG. 5 is an edge view of the mounted work of art represented in FIG. 4 showing the construction of the framework and the method of suspending the skin to the bars of the framework.

After hair has been removed from the surface portion 14 of the skin 11, acrylic paint is applied thereto, preferably consisting of different vivid, brilliant colors in simple geometric forms such as triangles, circles, square and rectangles, for example, to carry out the motif of tribal design. In some areas of the skin such as in the area 31 which is circular, the bare skin may be left unpainted as a part of the design. In other areas as indicated by the shaded portions of FIG. 3, different selected vivid pigments are applied. For example, there are painted circles 32 of different sizes along the neck of the representation of an animal and a substantially rectangular portion 33 of a different color surrounding a portion of the skin in which the hair has been left to form the representation of a head 34 of an animal. It can also be observed that there are sharp pointed triangular portions 35 to suggest symbolically the forelegs and hindlegs of an animal represented in the skin painting for tribal design. Although I have described the method of producing my works of art primarily in conjunction with accomplishing tribal design, it will be understood that my invention is not limited thereto and the methods may also be employed in connection with realistic painting.

Referring to FIG. 6 it will be understood that the staples 13 are driven into the skin only in those portions around the edges where the hair is to be left intact and no painting is to be done. After the painting has been finished the staples are removed to remove the painting from the wall 12 and a stiff backing sheet 36 is cut having substantially the same outline shape as the hide 11 and composed of a suitable material such as masonite, compact hardboard or plywood and the back surface of the hide is glued to the backing by a suitable adhesive such as leather glue.

The next step in the process is the formation of the mounting frame 41 by suitably notching wooden bars 42 and 43 for the horizontal and vertical members of the frame 41 at notches 44 so that the bars 42 and 43 may be inter-fitted and joined at the corners and then holes 45 are cut through the hide 11 and the backing sheet along the margins thereof including the projecting portions which originally formed the legs, tail and head of the animal so that the painting may be supported in the frame 41 by means of cords or thongs 46. Supporting means 47 are driven into the wooden bars 42 and 43 at suitable positions to cooperate with the holes 45 in the hide and its backing. The thongs 46 are passed around the supporting means 47 to permit suspending the painting in the framework 41. The cords 46 may take suitable form such as leather thongs harmonizing with the skin of the hide 11; and the supporting members 47 in the bars 42 and 43 may take the form of elements harmonizing with the animal motif such as horseshoe nails.

Certain embodiments of the invention and certain methods of operation embraced thereon have been shown and particularly described with the purpose of explaining the principle of operation of the invention and showing its application, but it will be obvious to those skilled in the art that many modifications and variations are possible, and it is intended therefore to cover all such modifications and variations as fall within the scope of the invention.

What is claimed is:

1. The method of producing a skin painting of desired design which comprises the steps of:

stapling a buffalo hide to a vertical surface, applying heat to hairs in selected areas of the hide to embrittle the hair thereon, utilizing a cutting tool with a curved edge varying progressively in curvature for enabling precisely varying and selected outlined segments to be formed at the margin of bare skin and hair by carving away the embrittled hairs from a selected area of the hide to form a bare surface area along outlines to form boundaries of selected portions of the desired design, applying acrylic pigment to the bare surface area in simple geometrical configurations such as triangles, circles and rectangles to form portions of the painting within such boundaries to produce a composite picture of applied pigment and hair retained on the skin, the configuration of boundaries being along lines representing tribal designs, cutting a stiff backing sheet with an outline following the outline of the hide, gluing the hide to the backing sheet, surrounding the hide with wooden frame members, piercing holes in the hide and backing sheet along the outline thereof, driving horseshoe nails into the frame members at points spaced from the pierced holes in the hide and backing sheet, passing a thong through the holes and looping the thongs around the horseshoe nails to mount the hide within the frame members, whereby a mounted tribal painting is produced from natural hides and protected from drying out, the boundaries between hair and portions of the hide from which hair has been removed being either carved away from elements of the design or carved into it so that either acrylic paints or hair remaining on the hide will form the desired element of the design.

2. The method of producing a rigid skin painting which comprises the steps of:

carving away a selected area of hair from an animal hide to form a bare surface area along outlines to form margins serving as boundary portions of the desired design of the painting, applying pigment to the bare surface area to form portions of the painting within such boundaries to produce a composite picture of applied pigment and hair retained on the skin of the hide, cutting a stiff backing sheet, gluing the skin to the backing sheet, and applying heat to the hairs in selected areas of the hide to embrittle the hair thereon prior to carving away the selected area.

3. The method of producing a rigid skin painting which comprises the steps of:

carving away a selected area of hair from an animal hide to form a bare surface area along outlines to form margins serving as boundary portions of the desired design of the painting, applying pigment to the bare surface area to form portions of the painting within such boundaries to produce a composite picture of applied pigment and hair retained on the skin of the hide, cutting a stiff backing sheet, and gluing the skin to the backing sheet, a cutting tool being utilized to cut away the selected areas of hair, the cutting tool having a curved edge varying progressively in curvature for enabling precisely varying and selected outline segments to be formed at the margin of bare skin and hair.

* * * * *